United States Patent [19]

McIntyre et al.

[11] 4,430,177

[45] Feb. 7, 1984

[54] ELECTROLYTIC PROCESS USING OXYGEN-DEPOLARIZED CATHODES

[75] Inventors: James A. McIntyre; Robert F. Phillips, both of Midland; Joseph D. Lefevre, Bay City, all of Mich.

[73] Assignee: The Dow Chemical Company, Midland, Mich.

[21] Appl. No.: 370,776

[22] Filed: Apr. 22, 1982

Related U.S. Application Data

[60] Division of Ser. No. 102,481, Dec. 11, 1979, Pat. No. 4,340,459, which is a continuation-in-part of Ser. No. 939,588, Sep. 5, 1978, abandoned.

[51] Int. Cl.[3] ..... C25B 1/16; C25B 1/24; C25B 11/03; C25B 11/08

[52] U.S. Cl. ..... 204/98; 204/128; 204/265; 204/284; 204/292

[58] Field of Search ..... 204/98, 128, 256, 258, 204/265-266, 284, 292

[56] References Cited

U.S. PATENT DOCUMENTS

| | | | |
|---|---|---|---|
| 832,196 | 4/1960 | Billiter . | |
| 2,273,795 | 2/1942 | Heise et al. . | |
| 2,275,281 | 3/1942 | Berl | 204/284 |
| 2,681,884 | 6/1954 | Butler et al. . | |
| 3,035,998 | 5/1962 | Sommer et al. | 204/284 |
| 3,238,069 | 3/1966 | Guth | 204/284 X |
| 3,262,868 | 7/1966 | Juda . | |
| 3,377,265 | 4/1968 | Caesar . | |
| 3,423,247 | 1/1969 | Darland, Jr. et al. . | |
| 3,708,416 | 1/1973 | Ruehlen et al. . | |
| 3,861,961 | 1/1975 | Kudo et al. . | |
| 3,864,236 | 1/1975 | Lindstrom | 204/265 |
| 3,923,628 | 12/1975 | Gritzner . | |
| 3,926,769 | 12/1975 | Gritzner . | |
| 3,963,592 | 6/1976 | Lindstrom . | |
| 4,035,254 | 7/1977 | Gritzner . | |
| 4,035,255 | 7/1977 | Gritzner . | |
| 4,086,155 | 4/1978 | Jonville | 204/284 X |
| 4,179,350 | 12/1979 | Deborski | 204/284 |
| 4,197,367 | 4/1980 | Deborski . | |
| 4,256,545 | 3/1981 | Deborski . | |

FOREIGN PATENT DOCUMENTS

| | | |
|---|---|---|
| 700933 | 9/1964 | Canada . |
| 688 | 9/1979 | Sweden . |
| 1407452 | 8/1972 | United Kingdom . |

*Primary Examiner*—Donald R. Valentine

[57] ABSTRACT

A porous, two layer electrode which may be used as an anode or a cathode and a cell using one or more of the electrodes. The electrode is in a pocket shaped configuration with the inner layer having interstitial passageways which are larger in diameter than the diameter of the corresponding interstitial passageways in the outer layer. The layers may be composed of metallic particles. A catalytically active material may be applied to the electrode. The electrodes are particularly useful as oxygen depolarized cathodes in electrolytic processes.

17 Claims, 2 Drawing Figures

ELECTROLYTIC PROCESS USING OXYGEN-DEPOLARIZED CATHODES

This is a divisional application of application Ser. No. 102,481, filed Dec. 11, 1979, now U.S. Pat. No. 4,340,459, which is a continuation-in-part application of application Ser. No. 939,588, filed Sept. 5, 1978, now abandoned.

BACKGROUND OF THE INVENTION

Oxygen-depolarized cathodes for electrolytic diaphragm cells are not new. Heise et al. in U.S. Pat. No. 2,273,795, Feb. 17, 1942, show a porous cathode wherein air or oxygen is blown through the cathode and into the catholyte.

Butler et al. in Canadian Patent No. 700,933, Dec. 29, 1964, show a hollow cathode such as a porous carbon cylinder which may be impregnated with a metal catalyst such as silver and through which air or oxygen is blown into the catholyte. In the catholyte are suspended particles or graphite, metal-coated graphite or metal which are kept suspended by air or oxygen blown through the cathode. They are said to act as collectors for the oxygen admitted through the cathode and react with the hydrogen evolved in the cathodic portion of the cell to form water.

Butler in U.S. Pat. No. 2,681,884, June 22, 1954, shows a porous carbon cathode into which air or oxygen can be passed, and shows the oxygen to react with water to form hydroxyl ions which are said thereafter to react with hydrogen ions in the vicinity of the active wall of the cathode.

Juda in U.S. Pat. No. 3,262,868, July 26, 1966, shows a fuel cell said to be useful also in electrolytic procedures. The cell comprises a porous catalytic fuel anode and a porous catalytic oxidant cathode, at least two ion exchange membranes between these electrodes disposed in a spaced relationship with each other and with both electrodes so as to define at least three compartments adapted to contain liquids therein, means for passing liquids into and out of these compartments, means for passing a catalytically reactive combustible fuel into the anode, means for passing a catalytically reactive oxidant gas into the cathode and means for passing a direct electric current between both electrodes.

Billiter in British Pat. No. 832,196, published Apr. 6, 1960, discloses preferably single metal cathodes in grid, wire mesh and sintered masses of small-sized metal grains and the like in the form of narrow boxes, hollow plates or the like. In use in electrolytic cells for electrolyzing aqueous solutions of alkali-metal compounds, air or oxygen under pressure is passed through such structures and may pass into the catholyte. Hydrogen evolution at the cathode is thereby said to be prevented.

Caesar in U.S. Pat. No. 3,377,265, Apr. 9, 1968, discloses a porous electrode for electrochemical cells comprising an electron-conductive support, a thin layer of fibrous alumina monohydrate on the support and an electrochemical catalyst disposed in and on the alumina layer. Perforate nickel may be the electro-conductive support. A carbon support having large pores may have disposed on its surface an alumina film having smaller pores to give a dual porosity electrode. In such electrolyte, the fuel gas makes contact on the side of the large pores and the aqueous electrode makes contact on the side of the small pores.

Gritzner in U.S. Pat. No. 3,923,628, Dec. 2, 1975, in the first of a series of four patents, discloses an oxygen-depolarizing cathode for use in a cell for producing chlorine and an alkali metal hydroxide from aqueous alkali metal chloride. The cathode shown has a wall portion adapted to be in contact with the catholyte and another wall portion substantially simultaneously adapted to be in contact with an oxidizing gas. A surface portion of the cathode at least partially defines an oxidizing gas compartment into which oxidizing gas, preferably oxygen, is fed. The cathode is advantageously a foraminous body having at least the surface including Ru, Rh, Pd, Ag, Os, Ir, Pt or Au with a coating of particulate metal admixed with a polymeric tetrafluoroethylene or a copolymer of hexafluoropropylene and tetrafluoropropylene. In one aspect, the cathode is a silver-coated woven copper screen with a mesh size of about 20 to about 50 with a coating of a mixture of platinum, silver or carbon particulates and a polymer or copolymer of the type indicated above. The oxygen prevents polarization by avoiding liberation of hydrogen at the wall in contact with the catholyte.

It is desired to provide an improved apparatus and process for reducing the electrical consumption of chlorine-producing electrolytic diaphragm cells.

SUMMARY OF THE INVENTION

An electrode has been invented which comprises a first electrically conductive porous layer which has a plurality of interconnecting passageways therethrough. The passageways have diameters of from about 7 to about 12 microns. The electrode has a second electrically conductive porous layer which has a plurality of interconnecting passageways therethrough. The passageways of the second layer have diameters of from about 0.1 to about 5 microns. The layers are joined into a wall structure in a manner so that a gas or a liquid may contact between the two layers. The wall structure is shaped into a pocket shape wherein the inner surface of the pocket is a surface of the first layer and the outer surface of the pocket is a surface of the second layer.

The electrode herein described may be used as either an anode or a cathode in an electrolytic cell. The use depends upon the type of cell in which the electrode is utilized. For example, the electrode may be used as an anode in a fuel cell, while it may be used as a cathode in an electrolytic cell. For the purposes of discussion, it will be assumed that the electrode will be used as a cathode in a chlor-alkali cell. However, this selection is merely for convenience of discussion and illustration and should in no way be construed to limit the invention to being a cathode only.

An electrolytic cell and an electrode have been developed. The electrolytic cell and electrode are particularly useful in producing chlorine and an alkali metal hydroxide. The electrolytic cell comprises an anode compartment spaced apart from a cathode compartment by an ion exchange membrane or a diaphragm. The anode compartment is suited to contain an anolyte such as an aqueous solution or mixture of an alkali metal chloride, for example, sodium chloride. The cathode compartment is adapted to contain a catholyte containing a hydroxide of an alkali metal. The diaphragms or ion exchange membranes separating the anode and the cathode compartments are suited to pass ions of at least the alkali metal from the anode compartments to the cathode compartment. The diaphragms or ion exchange membranes are suitably positioned in the electrolytic cell to separate each anode compartment substantially entirely from each cathode compartment. If desired, and as is well known in the art, a single container can contain a plurality of spaced apart anodes and cathodes in separate compartments. The cell of the present invention is also useful in the cell series known to those skilled in the art.

When the electrode is used as a cathode in a cell, an anode is suitably positioned within each anode compartment and a cathode is suitably positioned within each cathode compartment to be spaced apart from each diaphragm or membrane. Each cathode is further adapted to have its outer walls in contact with the catholyte and its inner wall or walls substantially simultaneously in contact with an oxidizing gas.

A means to supply a direct current to each anode and cathode is suitably electrically connected to these electrodes. When used to produce chlorine at the anode, the electrolytic cell further includes a means to recover the chlorine produced from each anode compartment and a means to remove the alkali metal hydroxide formed from each cathode compartment.

The described electrolytic cell is used advantageously in an improved process to produce chlorine and an alkali metal hydroxide. In the improved process, an alkali metal chloride brine is fed into each anode compartment. Sufficient electrical energy is supplied to each anode and cathode to release gaseous chlorine at each anode and to form an alkali metal hydroxide in each cathode compartment. The gaseous chlorine and alkali metal hydroxide are suitably recovered in usual ways known to those skilled in the art.

The electrical efficiency of the cell is improved by contacting substantially simultaneously an inner wall portion of each cathode with an oxidizing gas and an outer wall portion of each cathode with the catholyte. The catholyte is preferably circulated within each cathode compartment to maximize contact between the catholyte and the cathode walls to improve further the electrical efficiency of the cell.

DESCRIPTION OF THE DRAWING

The accompanying drawing further illustrate the invention.

Identical numbers, distinguished by a letter suffix, within the several figures represent parts having similar function within the different embodiments.

DESCRIPTION OF THE PREFERRED EMBODIMENTS

Figure 1:
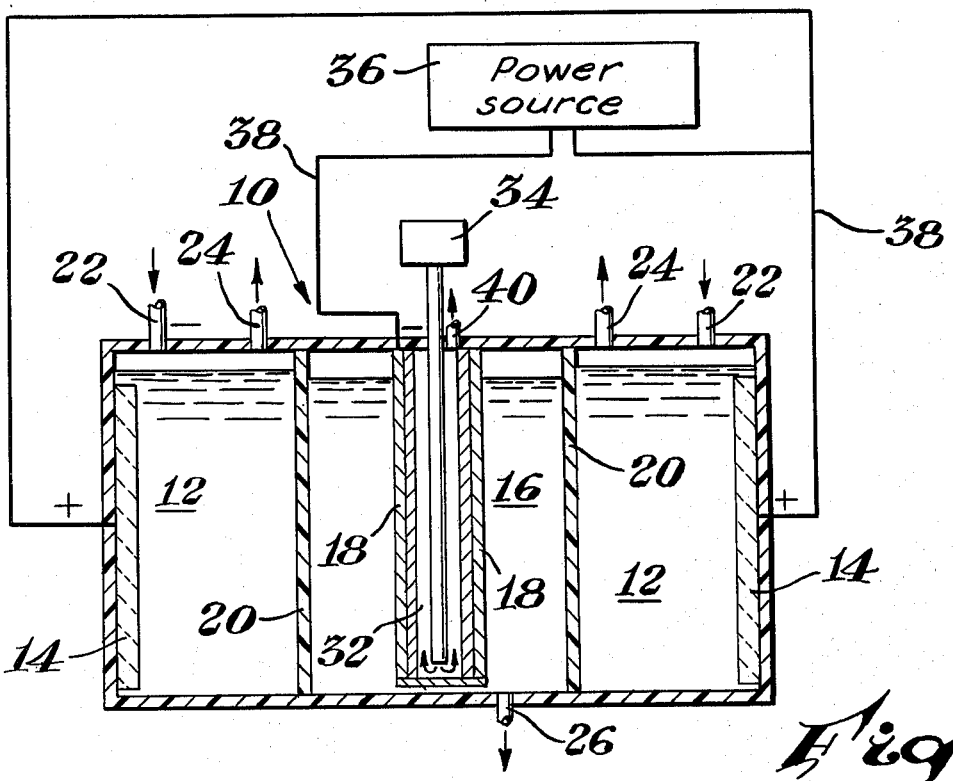
In FIG. 1 is shown a cross-sectional view of one embodiment of the invention.

An electrolytic cell 10 of FIG. 1 includes anode compartments 12 with anodes 14 positioned therein juxtaposed and spaced apart from a cathode compartment 16 with a depolarizing cathode 18 positioned therein. The anode compartments 12 are spaced apart from the cathode compartment 16 by diaphragms or ion exchange membranes 20 capable of passing at least alkali metal ions from the anode compartments 12 to the cathode compartment 16. The cathode is provided with a source 34 for feeding oxidizing gas to the oxidizing compartment 32. The electrolytic cell 10 further includes a source of alkali metal chloride brine (not shown) and a means 22 to introduce or feed the brine into the anode compartments 12. A gaseous chlorine removal means such as a pipe 24 is suitably connected to each anode compartment 12 to afford removal of gaseous chlorine without substantial loss of chlorine to the ambient atmosphere.

During operation of the electrolytic cell 10, the catholyte contains increasing concentrations of an alkali metal hydroxide, such as sodium hydroxide, which for efficient operation should be removed from the cathode compartment 16 to reduce the hydroxide concentration. For this purpose, an alkali metal hydroxide removal means such as pipe 26 is connected to the cathode compartment 16.

The cathode 18 is formed of two active walls, each having dual porosity heavy metal particulate layers, advantageously of metals of the first and eighth groups of the Mendeleef Periodic Table. The outer layer of each wall in contact with the catholyte is composed of heavy metal particles having a much smaller mean pore size than the particles of the inner layer. The two layers may be joined in any manner which will allow a gas or a liquid to pass from one layer to another layer. Thus, the layers may be held together by pressure, sintered or attached in other ways. It is not necessary that all of the interconnecting passageways of each layer connect with the interconnecting passageways of the other layers. However, the two must be joined so that at least some of the passageways of each layer connect with at least some of the passageways of the other layer. The two layers of each wall may be sintered together and have on the surfaces of their particles a catalytic film of a catalyst consisting of about 0.1 to 1 oz. of silver per sq. ft. of geometric area. The average pore size of the fine layer particles is about 0.1 to about 3 microns and preferably 2 microns. The average pore size of the coarse layer particles is about 7 to about 12 microns, preferably 10, as determined by the mercury porosimeter method; see Aminco Winslow Porosimeter Instruction Booklet No. 597; Winslow, W. M. & Shapiro, J. J.: "An Instrument for the Measurement of Pore-Size Distribution by Mercury Penetration", ASTM Bulletin, February 1958, page 39. The thickness of the particulate layers is about 0.010 to about 0.060 in (0.0254 to 0.1524 cm. ) for the fine particles and about 0.020 to about 0.090 in (0.051 to 0.2286 cm) for the coarse particles.

The particulate layers may be sintered together in usual ways. They may be surface coated with a catalyst, advantageously a platinum group metal such as platinum, palladium or silver. The catalytic coating may be applied by an electroplating or by an electroless plating process in known ways.

The cathode 18 is adapted to and is believed to transmit an oxidizing gas from a gas compartment 32 through the inner particulate active layer and substantially up to the boundary of each of the outer particulate layers of both of its walls. The fine pore size outer particulate layer has such a fine pore size that substantially no oxidizing gas escapes into the catholyte. An oxidizing gas feed control means 34 is provided and can, if necessary, regulatably control the dew point of the oxidizing gas introduced into the gas compartment 32 to minimize and preferably substantially eliminate accumulation of water within gas compartment 12.

Preferably, the oxidizing gas control means 34 is further adapted to maintain the oxidizing gas moisture content at a concentration sufficient to prevent removal of sufficient water from the catholyte to result in deposition of, for example, sodium chloride or sodium hydroxide in the pores of cathode 18.

A source of electrical energy 36 is electrically connected to an energy transmission means such as aluminum or copper conduit as bus bar or cables 38 to transmit direct current to anodes 14 and cathode 18.

In operation of the electrolytic cell, an alkali metal chloride containing brine, such as sodium chloride, is supplied or fed through the brine feed means 22 into the anode chambers 12 wherein, in usual ways, gaseous chlorine is formed and removed through pipes 24 and thence to a chlorine condensing and storage system (not shown). Sodium ions pass through ion exchange membranes 20 into the cathode compartment 16 wherein sodium hydroxide is formed. An asbestos or asbestos and polymer diaphragm as 20 can also be used. An oxidizing gas, preferably oxygen, is fed into gas compartment 32 within dual porosity double layer walls of cathode 18 substantially simultaneously with formation at the catholyte side of cathode 18 of the sodium hydroxide. The presence of the oxidizing gas and the physical contact thereof with the inner coarse particulate layers of the walls of cathode 18 while the outer fine particulate layers of the walls of cathode 18 are simultaneously in contact with the sodium hydroxide containing catholyte at the boundary with the inner coarse particulate layers, is believed to prevent formation of gaseous hydrogen in cathode compartment 16 (hydrogen formation is not observed), thereby to reduce the electrical consumption and improve the electrical efficiency of the cell. Excess oxidizing gas, e.g., when air is used as the oxidant, is removed from the inside of pocket 32 of cathode 18 through oxidizing gas removal means 40.

To optimize cell operation, it is preferred that substantially all of the catholyte be circulated at a rate sufficient for substantially all of the catholyte to contact the outside walls of cathode 18 and insufficient to result in physical injury to diaphragm 20.

Figure 2:
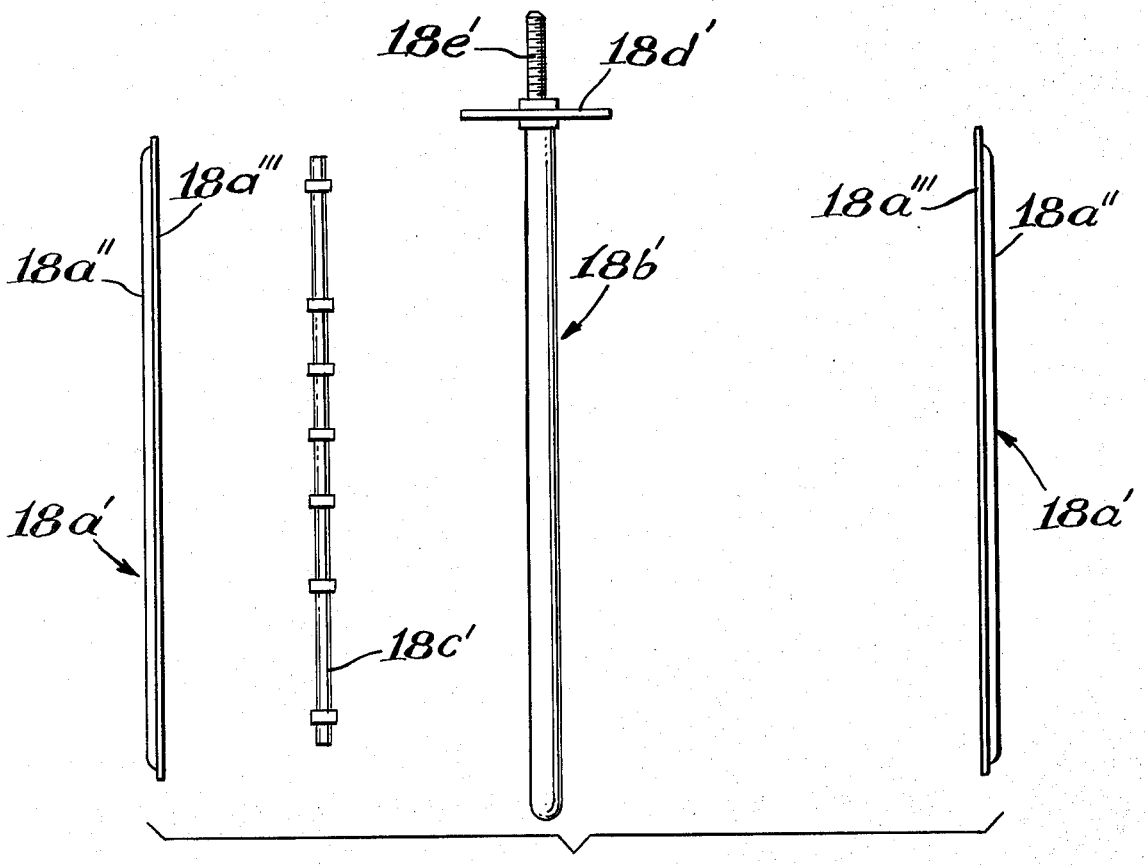
In FIG. 2 is shown an exploded plan view of an embodiment of a cathode of the invention.

FIG. 2 is illustrative of an exploded plan view of another embodiment of the cathode 18 in FIG. 1. Cathode walls 18*a'* illustrate outside catholyte-contacting sintered fine nickel particle containing layers 18*a''* coated with a catalytic layer of silver and inside oxidizing gas contacting sintered coarse nickel particle containing layers 18*a'''* also coated with a catalytic layer of silver. Their pore sizes are as described above. Cathode walls 18*a'* are mounted in cathode holder 18*b'* which may be made of resistant polymeric material such as, for example, polytetrafluoroethylene, polyvinyl chloride, polypropylene, chlorine- and alkali-resistant rubber, resistant metal such as nickel, resistant polymeric coated metal and the like. Tightness between the cathode holder 18*b'* and cathode walls 18*a'* can be obtained by means of special gaskets of resistant rubber or the like (not shown) in combination with fastening means such as resistant clamps or bolts (not shown). Cathode walls 18*a'* are mounted vertically in the electrolytic cell 10 of FIG. 1. Cathode holder 18*b'* may be made of a peripheral channel-containing shape surrounding the periphery of walls 18*a'* and having an inlet and an outlet for an oxidizing gas (not shown) and one or more intermediate openings (not shown) for letting the oxidizing gas fill up the interior of the cathode. Alternatively, other inlet and outlet means for supplying oxidizing gas to a depolarizing cathode, as conventionally used in known depolarizing cathodes, may be utilized. When the cathode walls 18*a'* are within the narrower thicknesses where added strength would be advantageous, an inner suppport 18*c'* of resistant material, advantageously plastic, mounted between the side walls is useful. For example, such a support having multiple spaced-apart support protuberances may be inserted between the side walls. Alternatively, the side walls 18*a'* may be mounted in a cathode holder, not shown, which holder has supporting walls substantially coextensive in planar area with side walls 18*a'*. The supporting walls may have a plurality of spaced apart openings to permit ready contact of catholyte with the outside cathode walls 18*a''*. An end plate 18*d'* is attached to the cathode holder 18*b'*, advantageously by welding, and may have oxidizing gas inlets and outlets (not shown) for communicating with the inside cathode walls 18'''. The end plate 18*d'* can be attached to the body of a cell by, for example, a plurality of fastening means 18*e'* such as bolts. The fine pore structure of the outer layers of the walls 18*a''* permits entry of catholyte substantially up to the boundary with the coarse pore layers 18*a'''*, but otherwise oxidizing gas pressure substantially prevents entry of catholyte into the coarse pore structure of the inner layers of the walls 18*a'''*. Also, the fine pore structure of the outer walls 18*a'''* prevents oxidizing gas from bubbling into the catholyte at pressures useful for feeding oxidizing gas into the cathode. Accordingly, a stable three-phase region is maintained where catholyte, catalyst and oxidizing gas meet, namely at the boundary between the coarse and fine pore layers of cathode walls 18*a'*, providing a lower overvoltage than with conventional cathodes.

The following examples further illustrate the invention.

EXAMPLE 1

An electrolytic cell substantially as shown in FIG. 1 having duPont Nafion 315 ion exchange membranes, titanium anodes coated with oxides of ruthenium and titanium and 1 in. (2.54 cm.) by 3 in. (7.62 cm.) pocket cathodes were used in two similar operations. A first cathode (cathode I) was fabricated from 3 and 10 microns mean pore size nickel for the fine and coarse layers, respectively, each layer being 0.02 in. (0.051 cm.) thick. The layers were sintered together, silver catalyzed by a surface replacement plating process to deposit a silver film and welded along the side and bottom edges to give a pocket cathode of an approximately oval shape. The nominal anode-cathode distance was 0.25 in. (0.635 cm.), the actual distance varying somewhat due to the curved surface of the cathode. In a second cathode (cathode II), a solid nickel strip about one fourth in. (0.635 cm.) was welded to the sides and bottom of the dual porosity nickel particulate layers, fabricated from 3 and 10 micron mean pore size nickel, the fine pore layer being 0.02 in. (0.051 cm.) thick and the coarse pore layer being 0.035 in. (0.089 cm.) thick, the layers having been sintered together and silver catalyzed as with the layers of cathode I. With cathode II, the anode-cathode distance was a constant 0.25 in. (0.635 cm.). An aqueous brine containing about 300 grams per liter sodium chloride was continuously fed into the anode chambers and a sodium hydroxide containing cell effluent was removed from the cathode chamber while each cell was operated at 0.5 ampere/in$^2$ (0.5 ampere per 6.45 cm.$^2$) of electrode surface. While chlorine gas was continuously removed from the anode chambers, it was unnecessary to remove any gaseous product from the cathode chambers while the depolarizing cathodes were fed oxygen or air. Performance of the cells using cathodes I and II, and comparisons with their operations while being fed nitrogen gas, i.e., under non-depolarizing conditions, and comparisons with a cell having a steel cathode in place of the depolarized cathode are given in the following table.

| | Cell Voltage | | | |
|---|---|---|---|---|
| | $O_2$ | Air | $N_2$* | Conventional Cell** |
| Cathode I | 2.075 | 2.434 | 2.875 | 3.075 |
| Cathode II | 1.845 | 2.018 | 2.700 | 2.900 |

*$H_2$ produced
**Having a non-depolarized steel cathode

As shown above, the hydrogen overvoltage on a high surface area nickel having a catalytic film of silver on its surface is approximately 0.2 volt less than on steel punch plate. By adding 0.2 volt to the cell voltage on nitrogen (wherein a silver on nickel cathode was used), there is obtained the voltage obtainable with a conventional cell having a steel cathode, as given in the above table.

EXAMPLE 2

The procedure of Example 1 when repeated with a scale up having a 3-foot high rectangular pocket cathode fabricated similarly to cathode II of Example 1 will give equally advantageous results, i.e., a cell voltage reduction of about 1.0 volt with oxygen as compared with the cell voltage obtainable with a conventional steel punch plate cathode. Again, no gaseous cathode product will be observed.

Equally advantageous results are obtainable when a sodium bromide brine is substituted for the sodium chloride brine of Example 2, in which case bromine and sodium hydroxide are the products of electrolysis instead of chlorine and sodium hydroxide.

What is claimed is:

1. A process for generating halogens and alkali metal hydroxide which comprises electrolyzing an aqueous alkali metal halide between a pair of electrodes separated by an ion exchange membrane or diaphragm, at least one of the electrodes having a first electrically conductive, catalytically active porous layer having a plurality of interconnecting passageways therethrough with diameters of from about 7 to about 12 microns and of a size sufficient to permit an oxidizing gas to permeate therethrough, and a second electrically conductive, catalytically active porous layer having a plurality of interconnecting passageways therethrough with diameters of from about 0.1 to about 3 microns and of a size sufficient to minimize said oxidizing gas from permeating therethrough, the layers being joined into a wall structure in a manner so that at least a portion of the passageways of the first layer interconnect with the passageways of the second layer;

said wall being in the shape of a pocket, wherein at least a portion of an inner surface of the pocket is a surface of the first layer and at least a portion of an outer surface of the pocket is a surface of the second layer.

2. The process of claim 1 wherein the electrolysis is catalyzed by metals above silver in the electroactive series.

3. The process of claim 1 wherein the electrolysis is catalyzed by silver.

4. The process of claim 1 wherein the alkali metal halide is a sodium chloride solution.

5. The process of claim 1 wherein the electrode having the first and second porous layers is an anode.

6. The process of claim 1 wherein the electrode having the first and second porous layers is a cathode.

7. The process of claim 6 wherein the oxidizing gas is fed to a portion of the inner surface of the pocket.

8. The process of claim 1 or 7 wherein the oxidizing gas is air.

9. The process of claim 1 or 7 wherein the oxidizing gas is oxygen.

10. A process for generating halogens and alkali metal hydroxide in an electrolytic cell having an anode in an anode compartment, a cathode in a cathode compartment and an anolyte in the anode compartment and a catholyte in the cathode compartment wherein said cathode has a first electrically conductive, catalytically active porous layer having a plurality of interconnecting passageways therethrough of a size sufficient to permit an oxidizing gas to permeate therethrough, and a second electrically conductive, catalytically active porous layer having a plurality of interconnecting passageways therethrough of a size sufficient to minimize said oxidizing gas from permeating therethrough, the layers being joined into a wall structure in a manner so that at least a portion of the passageways of the first layer interconnect with the passageways of the second layer;

said wall being in the shape of a pocket, wherein at least a portion of an inner surface of the pocket is a surface of the first layer and at least a portion of an outer surface of the pocket is a surface of the second layer;

the process which comprises maintaining an oxidizing gas in contact with at least a portion of the inner surface of the pocket causing the oxidizing gas to permeate through at least a portion of the first layer, contacting the catholyte with at least a portion of the outer surface of the pocket whereby the catholyte permeates through at least a portion of the second layer without permeating through the first layer thereby forming an interface between the oxidizing gas and the catholyte, passing a direct current from the anode to the cathode, forming a gaseous halogen at the anode and an alkali metal hydroxide in the cathode compartment, and removing alkali metal hydroxide from the cathode compartment.

11. The process of claim 10 wherein the electrolysis is catalyzed by metals above silver in the electroactive series.

12. The process of claims 10 wherein the electrolysis is catalyzed by silver.

13. The process of claim 10 wherein the passageways of the first porous layer have a diameter of from about 7 to about 12 microns.

14. The process of claim 10 wherein the passageways of the second porous layer have a diameter of from about 0.1 to about 3 microns.

15. The process of claim 10 wherein the anolyte is a sodium chloride solution.

16. The process of claim 10 wherein the oxidizing gas is air.

17. The process of claim 10 wherein the oxidizing gas is oxygen.

* * * * *